US007022057B2

(12) United States Patent
Colla

(10) Patent No.: US 7,022,057 B2
(45) Date of Patent: Apr. 4, 2006

(54) DEVICE FOR MANUFACTURING PACKING BAGS

(75) Inventor: Tiziano Colla, Dino (CH)

(73) Assignee: Water-Line SA, (CH)

( * ) Notice: Subject to any disclaimer, the term of this patent is extended or adjusted under 35 U.S.C. 154(b) by 0 days.

(21) Appl. No.: 10/629,473

(22) Filed: Jul. 29, 2003

(65) Prior Publication Data

US 2004/0132599 A1 Jul. 8, 2004

Related U.S. Application Data

(63) Continuation-in-part of application No. 10/029,527, filed on Dec. 20, 2001, now abandoned.

(51) Int. Cl.
*B31B 1/00* (2006.01)

(52) U.S. Cl. ..... 493/29; 493/8; 493/11; 493/14; 493/15; 493/18; 242/554.1

(58) Field of Classification Search ..... 493/8, 493/11, 13, 14, 15, 17, 18, 29; 242/554.1
See application file for complete search history.

(56) References Cited

U.S. PATENT DOCUMENTS

| | | | | |
|---|---|---|---|---|
| 4,070,951 | A * | 1/1978 | Bala | 493/24 |
| 5,000,725 | A * | 3/1991 | Bauknecht | 493/11 |
| 5,230,688 | A * | 7/1993 | Hatchell et al. | 493/193 |
| 5,298,104 | A * | 3/1994 | Absher | 156/363 |
| 5,388,387 | A * | 2/1995 | McElvy | 53/451 |
| 5,695,106 | A * | 12/1997 | Bauknecht | 226/2 |
| 5,849,123 | A * | 12/1998 | Rice | 156/64 |
| 5,868,658 | A * | 2/1999 | Wild | 493/212 |
| 6,267,714 | B1 * | 7/2001 | Wild et al. | 493/11 |
| 6,454,689 | B1 * | 9/2002 | Voss | 493/11 |
| 6,574,520 | B1 * | 6/2003 | Liu et al. | 700/96 |
| 6,601,506 | B1 * | 8/2003 | Dauer | 101/248 |

FOREIGN PATENT DOCUMENTS

| | | | |
|---|---|---|---|
| EP | 0400596 | B1 * | 5/1990 |
| JP | 02-233306 | | 9/1990 |
| JP | 09-272517 | | 10/1997 |

* cited by examiner

*Primary Examiner*—John Sipos
*Assistant Examiner*—Christopher Harmon
(74) *Attorney, Agent, or Firm*—The Webb Law Firm

(57) ABSTRACT

A device for manufacturing packing bags from two packaging films, comprising two transport rollers, each of which pulls a film from a respective feed roll. The two films have marks printed on them at regular intervals. The transport rollers are pressed against corresponding idler rollers which between them preferably form a feed gap for the films. Downstream of the two transport rollers, there is at least one first buffer taking up slack in the assemblage of the two films or accommodating the lengths of the two films to match each other. The device can be used to synchronize two films that are printed with a regular pattern so that the patterns match.

15 Claims, 3 Drawing Sheets

1
2
3
4
5
6
7
8
9
10
11
12
13
14
15
19
20
21
22
23
25
26
27
28
29
30
40
41
42
43
44
45
46
48
50
51

DEVICE FOR MANUFACTURING PACKING BAGS

CROSS REFERENCE TO RELATED APPLICATION

This application is a continuation-in-part application of U.S. patent application Ser. No. 10/029,527, filed Dec. 20, 2001, now abandoned, entitled "Device for Manufacturing Packaging Bags," which is hereby incorporated by reference.

BACKGROUND OF THE INVENTION

1. Field of the Invention

This invention relates to a device for manufacturing packing bags. It relates particularly to the manufacture of bags produced by aligning two packaging films and generating transverse seals across the width of the aligned films.

2. Description of Related Art

Packaging bags are frequently used to package oblong products or products that are longer than they are wide. The products in question are generally packaged with their longitudinal extension at a right angle to the transport direction of the film. This method results in higher packaging frequencies than if the products are packaged lengthwise.

The packaging films are generally supplied to the packaging machine printed on one side. On currently conventional printing machines, the width of the printed film is limited to approximately 120 cm. By folding this foil, it is therefore possible to manufacture bags with a usable inside length of approximately 57 cm. If longer products are to be packaged, two appropriately wider films must be used, one for the printed front side and the other for the back side. This back side was previously left unprinted or printed with a pattern that can be cut crossways at any point.

SUMMARY OF THE INVENTION

The object of this invention is to solve the problem described above. The invention teaches that this object can be accomplished by the combination of features disclosed in the claims.

The invention relates to a device for manufacturing packing bags from two packaging films. A first film is pulled from a first feed roller by a first transport roller. A second film is likewise pulled from a second feed roller by a second transport roller. Each film bears marks at respective constant intervals. Each transport roller is connected to a servomotor and an angle-of-rotation sensor. A control device, connected to the servomotors and an angle-of-rotation sensor, controls the speed of each servomotor. Each sensor scans the marks on the film passing over the respective transport roller. A control device, connected to the servomotors and all the sensors, controls the servomotors and consequently the alignment of the two films, so that a mark on the first film and a mark on the second film, having passed said first and second transport roller, come to coincide. At least one first buffer serves to take up slack in the assemblage of the two films and/or to accommodate the length of the first and second film to match each other.

This device may be provided with a first idle mechanism and a second idle mechanism, which together form a narrow feed gap between the two films, the gap being preferably wider than the sum of the thickness of the two films.

This device may be provided with a blowing nozzle blowing a stream of gas into the feed gap and/or a transverse sealing device, located downstream of the two idle mechanisms, forming a transverse seal to connect the two films with each other. In case that a transverse sealing device is used, which is located upstream of the first buffer, the marks on the first and second film come to coincide next to this transverse sealing device.

This first buffer may be equipped with a third sensor to measure the supply of the film assemblage in this first buffer. The third sensor is optionally connected to the control device to regulate the average speed of the first and second servomotors.

This device may also be provided with second buffers, upstream of the first and second transport rollers, serving to take up slack in each of the films supplied to the device of the invention. These buffers are equipped with fourth sensors to measure the supply of film in the respective buffers. The fourth sensors are linked to drive mechanisms to control the feeding of the respective films.

The idle mechanisms of the device may be rollers that rotate around axes so that the inclination of the plane formed by the feed gap and an immediately downstream guide mechanism of the films can be adjusted to the center vertical plane of the axes. The device may also contain a second transverse sealing device, located to the guide mechanism of the films that immediately follows the first transverse sealing device. Optionally, the distance between the first and second sensors and the first and second idle mechanisms is adjustable.

DETAILED DESCRIPTION OF THE INVENTION

Figure 1:
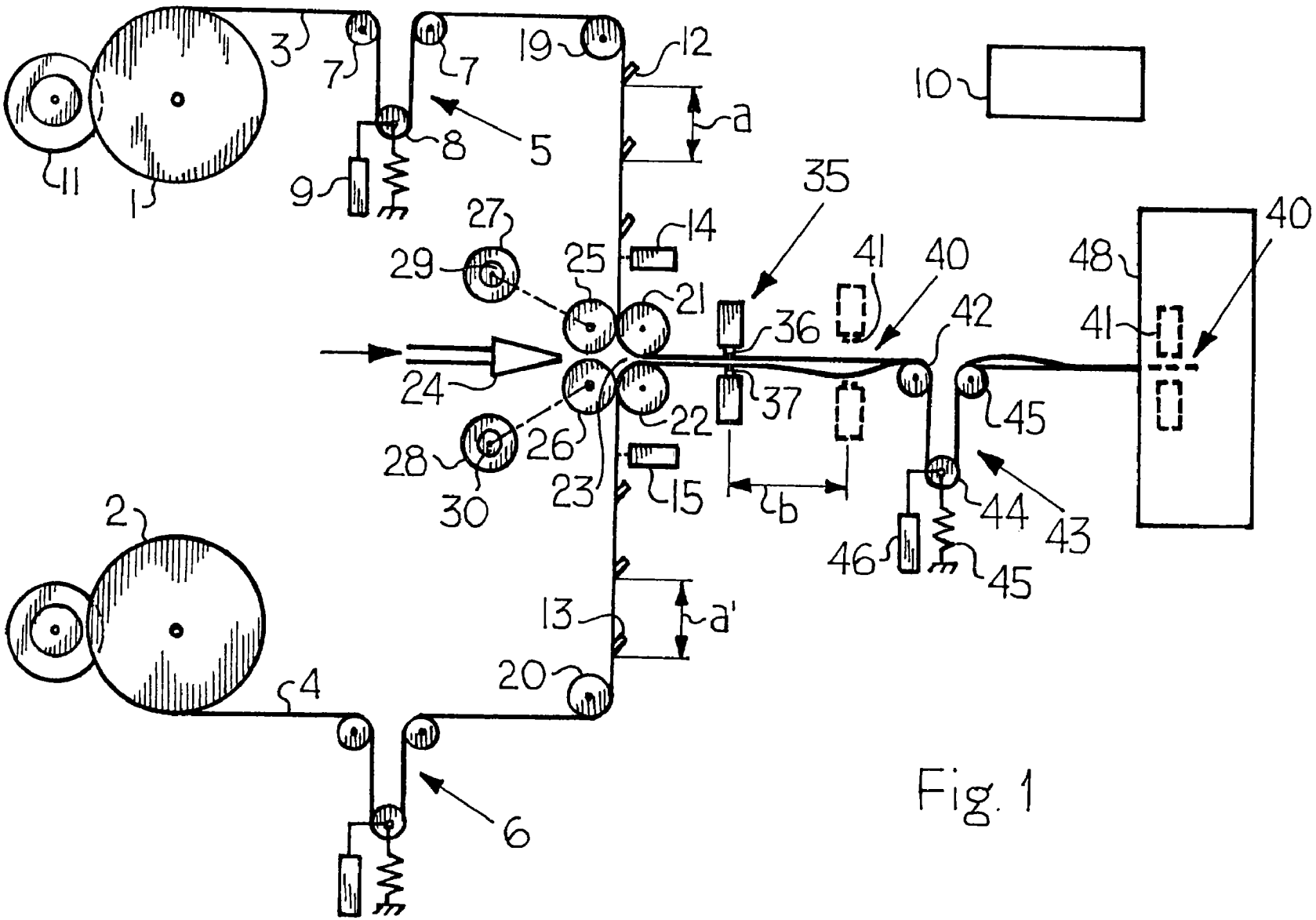
FIG. 1 is a schematic illustration of the device according to the present invention.

From two feed rollers 1, 2, two packing films 3, 4 are fed to two buffers 5, 6. The packaging films 3, 4 can be made of plastic or paper or any other suitable material. The buffers 5, 6 are represented symbolically by two idle rollers 7 and a spring-loaded compensating roller 8, the vertical travel of which (content of the buffer) is measured by a displacement sensor 9. The displacement sensor 9, via a central control unit 10, controls the drive motor 11 of the respective feed roller 1 or 2 so that content of the buffer remains approximately constant. The film 3 is printed with a mark 12 at a regular, constant interval a, and the foil is printed with a mark 13 at an interval a', a is approximately equal to a' and equals an integral multiple of the longitudinal grid with which the foils 3, 4 are printed: Two sensors 14, 15 are connected with the unit 10 and detect the marks 12, 13 as the foil passes, e.g., the front or rear edge of a line as it passes through.

From the buffers 5, 6 the films 3, 4 run over idle rollers 19, 20, 21, 22. The rollers 21, 22 form a narrow feed gap 23 that is approximately 0.05 to 2 mm wide. The gap 23 is in any case wider than the sum of the thickness of the two films 3, 4. Compressed air is blown into the gap 23 through a plurality of blast nozzles 24 that are distributed over the length of the feed gap 23, or through a narrow slotted nozzle. Transport rollers 25, 26 press the respective films 3, 4 against the rollers 21, 22. The rollers 25, 26 are each connected with a servomotor 27, 28 and an angular sensor 29, 30. The motors 27, 28 and sensors 29, 30 are likewise connected with the control unit 10.

Downstream although as close as possible to the idle rollers 21, 22, there is a transverse sealing station 35 that consists of a vertically movable sealing jaw 36 and a mating jaw 37. The sealing stroke of the jaw 36 is controlled by the unit 10, The sealing jaw 36 welds the two films 3, 4 to each other in the direction transverse to their direction of forward movement with a continuous or with a non-continuous seam, e.g., by only a few tack welds across the width of the films 3, 4 or only on one edge or on both edges.

If the transverse seal is not continuous, a continuous transverse is created in a second transverse sealing station 40, e.g., in the subsequent packing machine 48, with a sealing jaw 41 and a corresponding mating jaw in the same location.

Alternatively, the second sealing station 40 can be located at an adjustable distance b downstream of the sealing station 35, as indicated by the broken lines. In that case, the jaws 36, 41 move simultaneously.

Downstream of the sealing station 35 is another buffer 43 with at least three rollers 42, 44, 45, at least one of which is loaded, e.g., by a spring, to pull the films 3, 4. The amount of film on the buffer 43 is, in turn, measured by a sensor 46 which is connected with the unit 10. From the buffer 43, the films 3, 4 welded crosswise are pulled trough the packaging machine 34, in which products are filled into the bags formed by the transverse seam, the longitudinal edges of the films 3, 4 are sealed and optionally bags are separated from one another.

Figure 3:
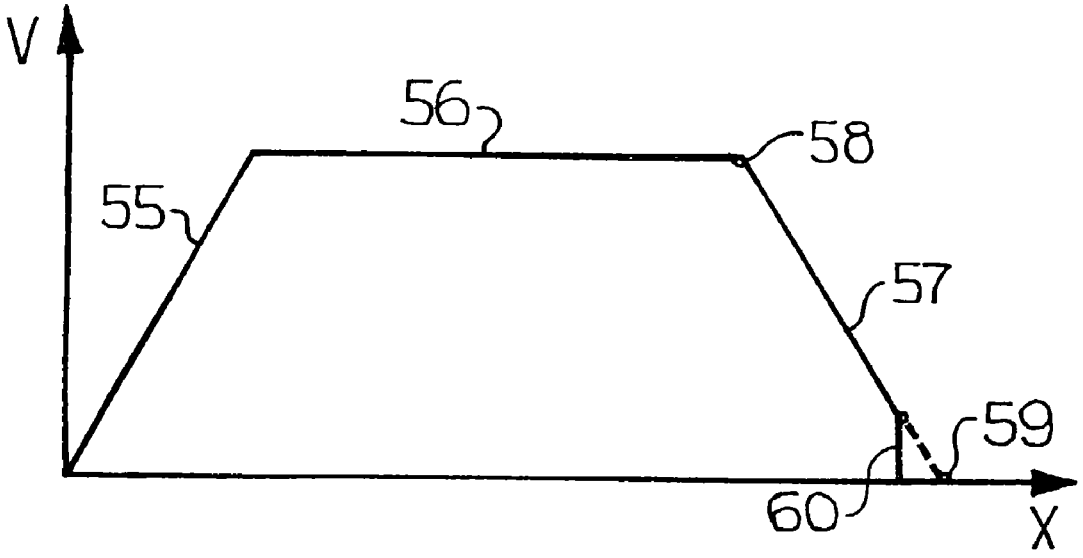
FIG. 3 is a graph depicting the speed profile of driving rollers in the device of the present invention.

One possible mode of operation of the device described above is explained below: The packaging machine 48 operates in cycles or continuously, and accordingly pulls transversely welded films 3, 4 from the buffer 43 in cycles or continuously. The unit 10 regulates the average speed of the motors 27, 28 by means of the signal from the sensor 46, so that the content of the buffer 43 remains approximately constant. After the transverse sealing has been performed in station 35 and the buffer 43 has signaled by means of the sensor 46 that it requires more material, the two motors 27, 28 are actuated by the device 10 and drive the rollers 25, 26 with a programmed speed profile as illustrated in FIG. 3. This profile has an acceleration phase 55, a constant speed phase 56 and a deceleration phase 57. The transition point 58 between the phase 56, 57 and the deceleration in the phase 57 are designed so that at the theoretical stopping point 59, the trailing edge of the next mark 12 or 13 used to switch the sensor 14 or 15 respectively is somewhat downstream of the respective sensor 14 or 15. This trailing edge therefore passes the related sensor 14, 15 at a greatly reduced speed. When this sensor 14, 15 responds, the corresponding motor 27, 28 is stopped immediately (deceleration phase 60 in FIG. 3). On account of the low speed of the rollers 26, 27, the distance traveled between the stop signals and until the films 3, 4 come to a stop is very short and can also be measured and corrected by means of the signal from the sensors 29 and 30 respectively. Therefore the films 3, 4 stop with the marks 12, 13 very accurately oriented with respect to the sensors 14, 15. The sealing station 35 is located along the films 3, 4, accurately measured by an integral multiple of the distance a downstream of the stopping point thereby reached by the marks 12, 13 measured for stopping, or farther away by an adjustable amount c, whereby $0 \leqq c \leqq a$. At the sealing station 35, therefore two passing marks 12, 13 are accurately aligned with each other and with the sealing jaw 36, or are downstream of this sealing jaw 36 by the amount c. At this point, the sealing jaw 36 and optionally the sealing jaw 41 are actuated, whereupon the next cycle begins.

As the films 3, 4 are pulled trough the rollers 25, 26, the content of the buffer 5, 6 is correspondingly reduced, whereupon the motors 11 are turned on by means of the sensors 9 and the control unit 10.

The device described above and the operating method described above make possible the accurate orientation of the marks 12, 13 during the transverse sealing of the films to each other. It is thereby possible to print both sides of packaging bags formed by two separate films with self-contained patterns that are related to the product. For example, the front side can be used as an advertising area and the back side can contain more detailed specifications concerning the product or a recipe, for example, something that was previously considered impossible. Using the device taught by the invention, it is also possible to form product-specific printed packaging bags made of foils that differ on the two sides of the package in terms of material and thickness. In certain cases, therefore, the need to insert cardboard supports can be eliminated.

For example, if the distance a', on account of manufacturing tolerances or elastic expansions or temperature differences, etc., is slightly greater than a, the film 4 becomes slack between the sealing station 35 and the idle roller 42 or between the sealing stations 35, 40, because only the "shorter" film 3 is stretched between the rollers 42 and 21 by the tension of the spring 45.

The blowing of air into the feed gap 23 has a number of advantages. On account of the constriction of the air current in the feed gap 23, an underpressure is created there and immediately behind the gap by the Venturi effect, which sucks the films 3, 4 toward one another. This significantly simplifies the sealing station 35. Downstream of the station 35, on the other hand, an overpressure forms between the films 3, 4. This overpressure stretches the slack film 4. It is thereby assured that the film 4 is stretched between the roll 22 and the station 35, i.e., it cannot bulge. It thereby becomes possible to accurately alight the two marks 12, 13 next to the station 35 for the tack sealing.

If the distance a and a' are exactly equal when the films 3, 4 are not stretched and the films 3, 4 are made of the same thickness, the distance a' will sometimes be slightly greater and sometimes slightly less than a, for example on account of the different amount of material in the buffers 5, 6 that occur during operation or the different stresses in the films 3, 4 over the distance between the sensors 14, 15 and the sealing station 35. Consequently, between the stations 35, 40, sometimes the bottom film 4 (as shown in FIG. 1) and sometimes the top film goes "slack", i.e., it is pulled only by the pneumatic pressure. The tension exerted by the buffer 43 therefore acts alternately on the film 3 and then on the film 4. At the transfer points, this tension is transmitted only via tack welds of the transverse weld laid down in the station 35.

To prevent this, it is appropriate to select a' larger or smaller than a by a slight amount, for example, by 0.2 mm, i.e., the width of the pattern on the film 3 is systematically smaller or larger by 0.2 mm than the width of the pattern on the film 4, i.e. $0 \leqq |a-a'| \leqq 0.1\ a$.

The distance a is an integral multiple n of the width of the pattern on the film 3. For example, if n=3, that means that the circumference of the printing rollers with which the pattern is printed on the films 3, 4 is equal to 3*a* or 3*a*'. If n=1, the motors 27, 28 can be regulated in the manner explained above, so that the above-mentioned synchronization is performed only every nth pass of the marks 12, 13 through the sensors 14, 15 does. In that case, after the motors 27, 28 are stopped, at which point sealing jaws 36, 41 are lowered simultaneously, during the next two stops only the sealing jaw 41 is lowered. In both of the cases explained above, the cycle frequency of the control system can be accordingly reduced or the potential average discharge speed of the packaging machine 48 can be increased.

The distance that the films 3, 4 travel between the passage of the marks 12, 13 past the sensors 14, 15 and the time the motors 27, 28 stop can be set by programming the control unit 10. For a fast and accurate adjustment, however, it may be appropriate to make the distance of the sensor 14 and/or of the sensor 15 from the idle rollers 21, 22 adjustable, e.g., to mount each of the sensor 14, 15 on a sled that can be displaced by a threaded spindle.

If the machine is to be used for different pattern widths, i.e., if it must be possible to set different distances a, the distance b must also be adjustable.

Figure 2:
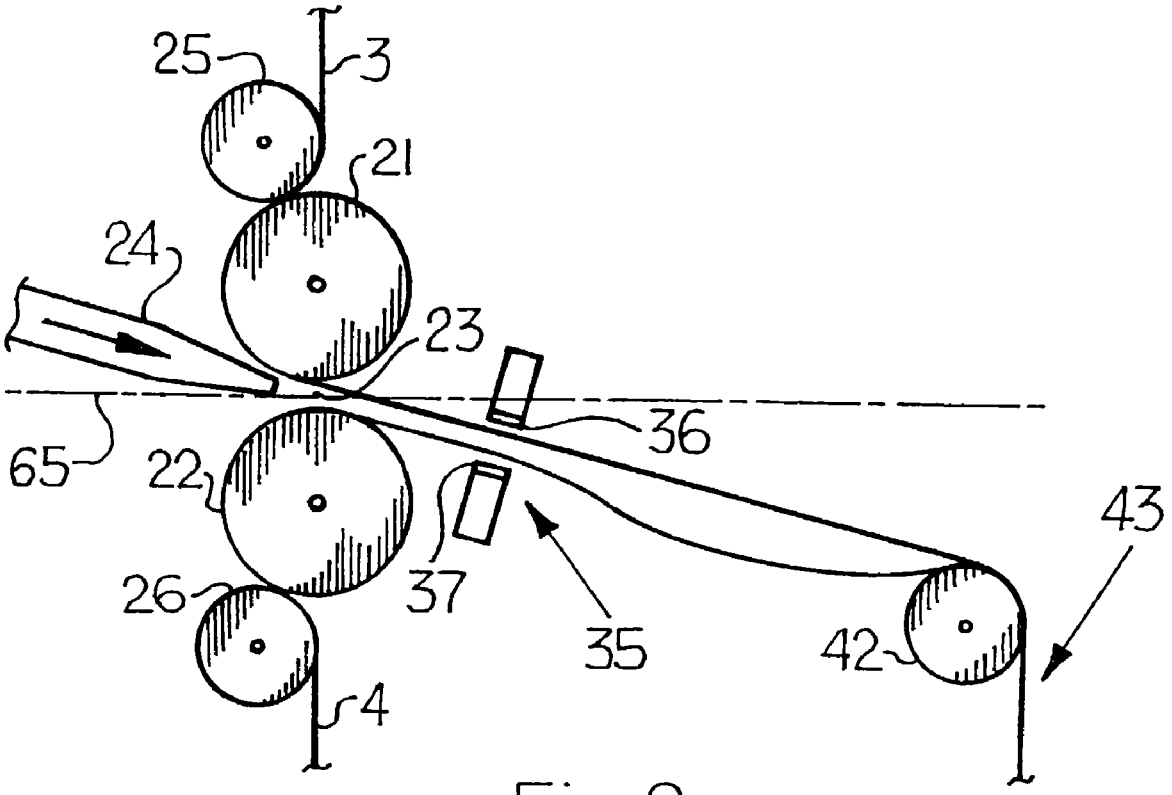
FIG. 2 is a detail of the idle mechanism, blower nozzle and sealing device of the present invention.

FIG. 2 shows one possibility of adjusting the gap width of the feed gap 23. The height of the roll 42 can be adjustable with respect to the vertical plane 65 between the axes of the rollers 21, 22.

The above explanation describes one possible mode of operation of the device described above when the machine is operated in cycles. It is also possible, however, to operate the device continuously. For that purpose, the sealing stations 35, 40 must be realized with rotating sealing jaws and mating jaws, e.g., as described in EP A-469 819, and must each be driven continuously by means of respective servomotors, which are correctly synchronized, e.g., with the servomotor 27. In this case, the servomotor 27 would be the master, the speed of which is regulated by means of the signal from the sensor 46. The motor 28 is the slave, the speed of which essentially equals the speed of the motor 27, but which is corrected with each (or every nth) passage of the marks 12, 13 past the sensors 14, 15, so that the marks 12, 13 coincide exactly after they pass trough the sealing station 35.

In another preferred embodiment the device has the same features as described above and shown in FIG. 1 except that it does not comprise the blower nozzle 24 and the sealing jaw 36 and the mating jaw 37.

In this case, the embodiment is preferably made as shown in FIG. 2. The same reference numbers are used for identical features already shown in FIG. 1. Therefore, the device according to FIG. 2 is not described in detail, but reference is made to the above description related to FIG. 1.

The device according to FIG. 2 functions in the same way as the one shown in FIG. 1. However, it does not need any blast nozzles 24 or a sealing station 35 located nearby the transport rollers 25, 26. Like the first embodiment, the two films 3, 4 are transported by the transport rollers 25,26 and pass the idle rollers 21, 22. The two films 3,4 passing the idle rollers 21, 22 are preferably but not necessarily spaced apart only by a small gap 23. The gap 23 is preferably but not necessarily wider than the sum of the thickness of the two films 3, 4. At this location, the two films 3, 4 and their markers 12, 13 are synchronized. Downstream of these idle rollers 21, 22, the two films 3, 4 are once again separated. Each film 3, 4 passes through its own buffer 43. Preferably, both buffers are built in an identical way. These buffers 43 are also called dancers and comprise a tensioning system.

Figure 4:
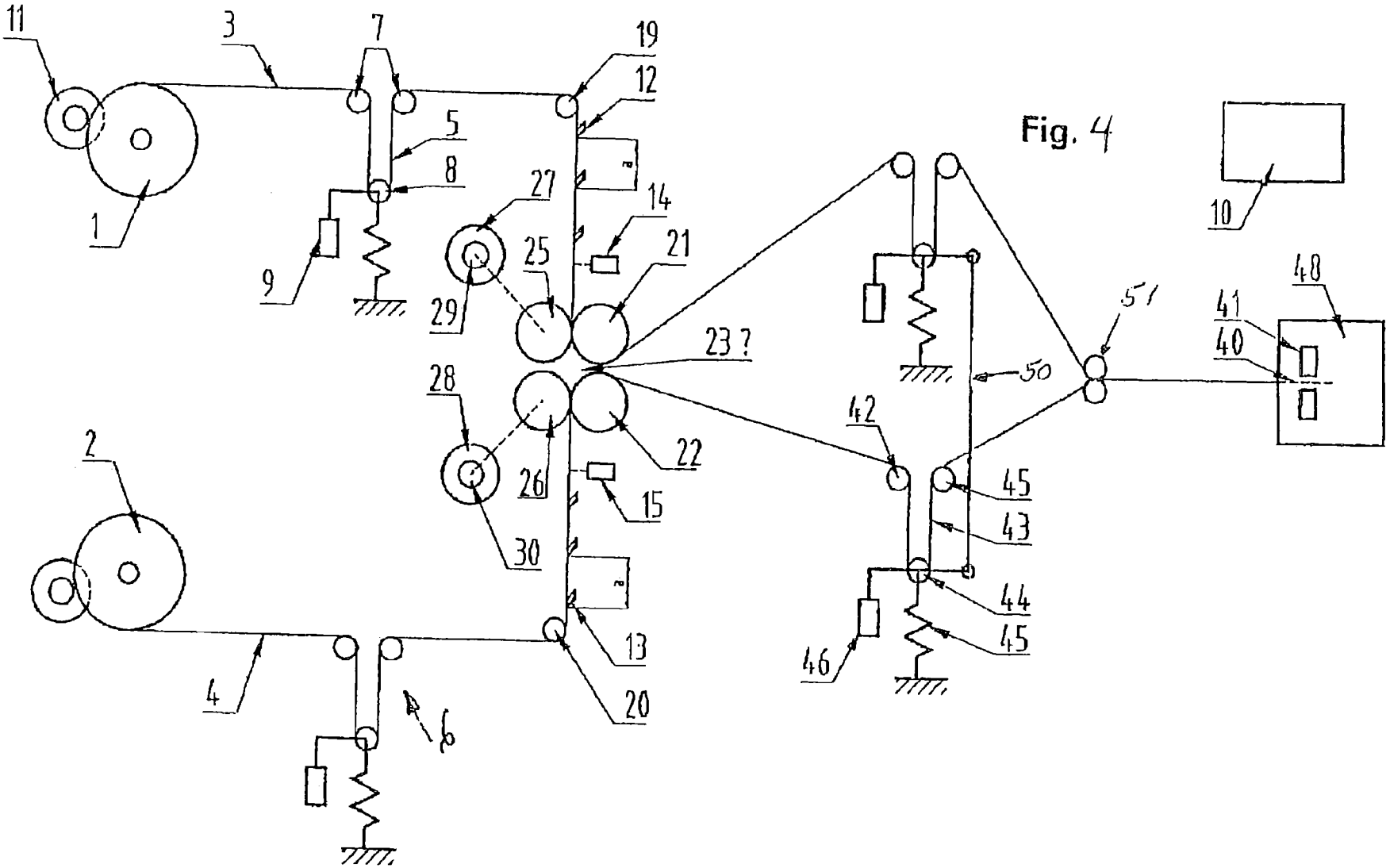
FIG. 4 is a schematic illustration of the device according to the present invention in a second embodiment.

The two buffers 43 are electronically or mechanically linked together, this link being shown in FIG. 4 with reference number 50. Similar to the buffer 43 shown in FIG. 1, these two buffers 43 are used to adjust the length of the two synchronized films 3, 4. The link between the two buffers 43 allows stretching of the shorter film in order to accommodate it to the longer one.

The sensors 46 of each buffer 43 measure once again the supply of the respective film. In this embodiment, it is usually not necessary to use its signal to regulate the speed of the motors 27, 28. After having passed the two buffers 43, the two films 3, 4 can be brought together at any time. In the embodiment shown in FIG. 4, they are guided through a pair of guiding rollers 51 and forwarded as into a packaging machine 48, where they can be sealed together in a sealing station 40.

The films 3, 4 do not have to be sealed shortly after synchronization. Once the films 3, 4 are synchronized by use of the two servomotor-driven rollers 25, 26, this synchronization will be maintained due to the two buffers 43 linked together. Therefore, the synchronized films 3,4 can be divided even after their synchronization. For example, this division is necessary if a third film shall be inserted, such as a side gusset. Another advantage is that since no preliminary sealing line has to be applied shortly after synchronization, such a line does not have to be brought in a position matching with other sealing points in the packaging machine later on.

Furthermore, no compressed air is needed, which reduces the production costs for the device and enables the device to be used also in delicate environments.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A device for manufacturing packaging bags, comprising:

a first transport roller to pull a first film from a first feed roller, whereby the first film has first marks at a constant first interval (a), a second transport roller independent of said first transport roller to pull a second film from a second feed roller, whereby the second film has second marks at a constant second interval (a'), a first servomotor that is connected with the first transport roller and with a first angle-of-rotation sensor, a second servomotor that is connected with the second transport roller and with a second angle-of-rotation sensor, a first sensor that is located upstream of and next to the first transport roller and scans the first marks, a second sensor that is located upstream of and next to the second transport roller and scans the second marks, a control device which is connected with the first servomotor, the second servomotor, the first sensor, the second sensor, the first angle-of-rotation sensor and the second angle-of-rotation sensor, and which controls the first servomotor and the second servomotor so that a first mark and a second mark, having passed said first and second transport roller, come to coincide and at least one first buffer for at least one of said first and second film, the at least one first buffer being located downstream of said first and second transport roller, and wherein the device comprises: a first idle mechanism and a second idle mechanism that together form a narrow feed gap for the two films, said first and second idle mechanisms being located downstream of the first and second transport roller respectively and wherein the at least one first buffer is located downstream of said first and second idle mechanism.

2. The device according to claim 1, wherein the feed gap is wider than the sum of the thickness of the two films.

3. The device as claimed in claim 1, wherein the device comprises a second buffer located upstream of each of said first and second transport rollers, said second buffers being used for one of said films each.

4. The device as claimed in claim 3, wherein said two second buffers are coupled with each other.

5. The device as claimed in claim 1, wherein said at least one first buffer is a tensioning system.

6. The device as claimed in claim 1, wherein there is one single first buffer, said single first buffer being used for both of said films.

7. The device as claimed in claim 1, wherein there is at least one third sensor to measure the supply in said at least one first buffer.

8. The device as claimed in claim 1, wherein the absolute amount of the difference between the first interval (a) and the second interval (a') is greater than 0 but less than 0.1 times the first interval (a).

9. The device as claimed in claim 1, wherein the device comprises a third and fourth buffer located upstream of the first and second transport rollers.

10. The device as claimed in claim 9, wherein the first and second supply each have a drive mechanism which is controlled by a fourth sensor to measure the supply in the corresponding second buffer.

11. The device as claimed in claim 1, wherein it comprises a transverse sealing device downstream of the two idle mechanisms to form a transverse seal to connect the two films with each other.

12. The device as claimed in claim 10, wherein a second transverse sealing device is located next to a guide mechanism of the films that immediately follows the first transverse sealing device.

13. The device as claimed in claim 11, wherein the transverse sealing device is the first sealing device in a path passed by the two films from said feed rollers to said at least one first buffer, wherein said transverse sealing device is located downstream of said at least one first buffer.

14. The device as claimed in claim 1, wherein the distance between the first and second sensors and the first and second idle mechanisms is adjustable.

15. The device as claimed in claim 1, further comprising a blower nozzle to blow a stream of gas into the feed gap.

* * * * *

UNITED STATES PATENT AND TRADEMARK OFFICE

CERTIFICATE OF CORRECTION

PATENT NO. : 7,022,057 B2
APPLICATION NO. : 10/629473
DATED : April 4, 2006
INVENTOR(S) : Colla It is certified that error appears in the above-identified patent and that said Letters Patent is hereby corrected as shown below:

Face of Patent, Priority Information
Column 1, Item (30) Foreign Application Priority Data,
Insert:

-- Dec. 20,2000 (CH) ..... 2481/00 --

Signed and Sealed this

Twentieth Day of February, 2007

JON W. DUDAS
*Director of the United States Patent and Trademark Office*